US011279160B2

(12) United States Patent
Minami

(10) Patent No.: US 11,279,160 B2
(45) Date of Patent: Mar. 22, 2022

(54) PRINTING APPARATUS

(71) Applicant: BROTHER KOGYO KABUSHIKI KAISHA, Nagoya (JP)

(72) Inventor: Akira Minami, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/823,100

(22) Filed: Mar. 18, 2020

(65) Prior Publication Data

US 2020/0307290 A1 Oct. 1, 2020

(30) Foreign Application Priority Data

Mar. 27, 2019 (JP) ..... JP2019-059685

(51) Int. Cl.
*B41J 2/355* (2006.01)
*B41J 29/38* (2006.01)

(52) U.S. Cl.
CPC ..... *B41J 29/38* (2013.01); *B41J 2/355* (2013.01)

(58) Field of Classification Search
CPC ..... B41J 2/3555; B41J 2/0458
See application file for complete search history.

(56) References Cited

U.S. PATENT DOCUMENTS 10,596,827 B2 * 3/2020 Goetz ..... B41J 2/04515

FOREIGN PATENT DOCUMENTS

| | | |
|---|---|---|
| JP | 2001-270143 A | 10/2001 |
| JP | 2008-201017 A | 9/2008 |
| JP | 2011-62896 A | 3/2011 |

* cited by examiner

*Primary Examiner* — Lam S Nguyen
(74) *Attorney, Agent, or Firm* — Kenealy Vaidya LLP

(57) ABSTRACT

There is provided a printing apparatus including: a head including M of heating elements arranged in a first direction; a memory, and a controller. The controller is configured to: measure first particular values indicating characteristics of N of heating elements and save the first particular values in the memory; measure second particular values indicating characteristics of the N of heating elements and save the second particular values in the memory; determine difference values between the first particular values and the second particular values; determine a characteristic value based on the difference values; and detect replacement of the head when the controller has determined that the characteristic value exceeds a predefined threshold value.

6 Claims, 4 Drawing Sheets

PRINTING APPARATUS

CROSS REFERENCE TO RELATED APPLICATION

The present application claims priority from Japanese Patent Application No. 2019-059685 filed on Mar. 27, 2019, the disclosure of which is incorporated herein by reference in its entirety.

BACKGROUND

Field of the Invention

The present disclosure relates to a printing apparatus.

Description of the Related Art

There is publicly known a thermal printer including a sensor that detects disconnection of a thermal head. The sensor that detects disconnection detects whether each heating element is disconnected based on a current value obtained when each heating element of the thermal head is energized one by one. The thermal printer determines that replacement of the thermal head is performed when the sensor has detected the change in the heating element from a state in which the heating element is disconnected to a state in which the heating element is not disconnected. The thermal printer is thus not provided with a dedicated sensor for detecting the replacement of the thermal head.

SUMMARY

The above thermal printer determines whether the replacement of the thermal head is performed after the sensor that detects disconnection measures the current values of all the heating elements one by one. This lengthens a time for detecting the replacement of the thermal head.

An object of the present disclosure is to provide a printing apparatus that is capable of shortening a time required for detecting replacement of a head.

According to an aspect of the present disclosure, there is provided a printing apparatus including: a head including M of heating elements arranged in a first direction and configured to perform printing of a printing image by heating the M of heating elements while moving relative to a printing medium; a memory; and a controller. The controller is configured to: measure a plurality of first particular values indicating characteristics of N of heating elements included in the M of heating elements at a first timing; save, in the memory, the plurality of first particular values of the N of heating elements measured; measure a plurality of second particular values indicating characteristics of the N of heating elements of which first particular values are measured at a second timing, the second timing being different from the first timing; save, in the memory, the plurality of second particular values of the N of heating elements; determine a plurality of difference values between the plurality of first particular values and the plurality of second particular values for the respective N of heating elements based on the plurality of first particular values and the plurality of second particular values of the N of heating elements saved in the memory; determine a characteristic value based on the plurality of difference values; and detect replacement of the head in a case that the controller has determined that the characteristic value exceeds a predefined threshold value.

In the above configuration, the printing apparatus measures the first particular values and the second particular values of the respective N of heating elements, and calculates the difference values between the first particular values and the second particular values for the respective N of heating elements. The printing apparatus determines the characteristic value based on the difference values determined. When the printing apparatus has determined that the characteristic value exceeds the predefined threshold value, the printing apparatus determines that the head replacement is performed. The printing apparatus thus detects the head replacement without using a dedicated sensor. The printing apparatus only has to measure the first particular values and the second particular values of the N of heating elements that are required for the determination of the characteristic value, thus reducing the time required for detecting the head replacement. The printing apparatus can also detect the head replacement when the heating elements are not disconnected.

DESCRIPTION OF THE EMBODIMENTS

Figure 1:
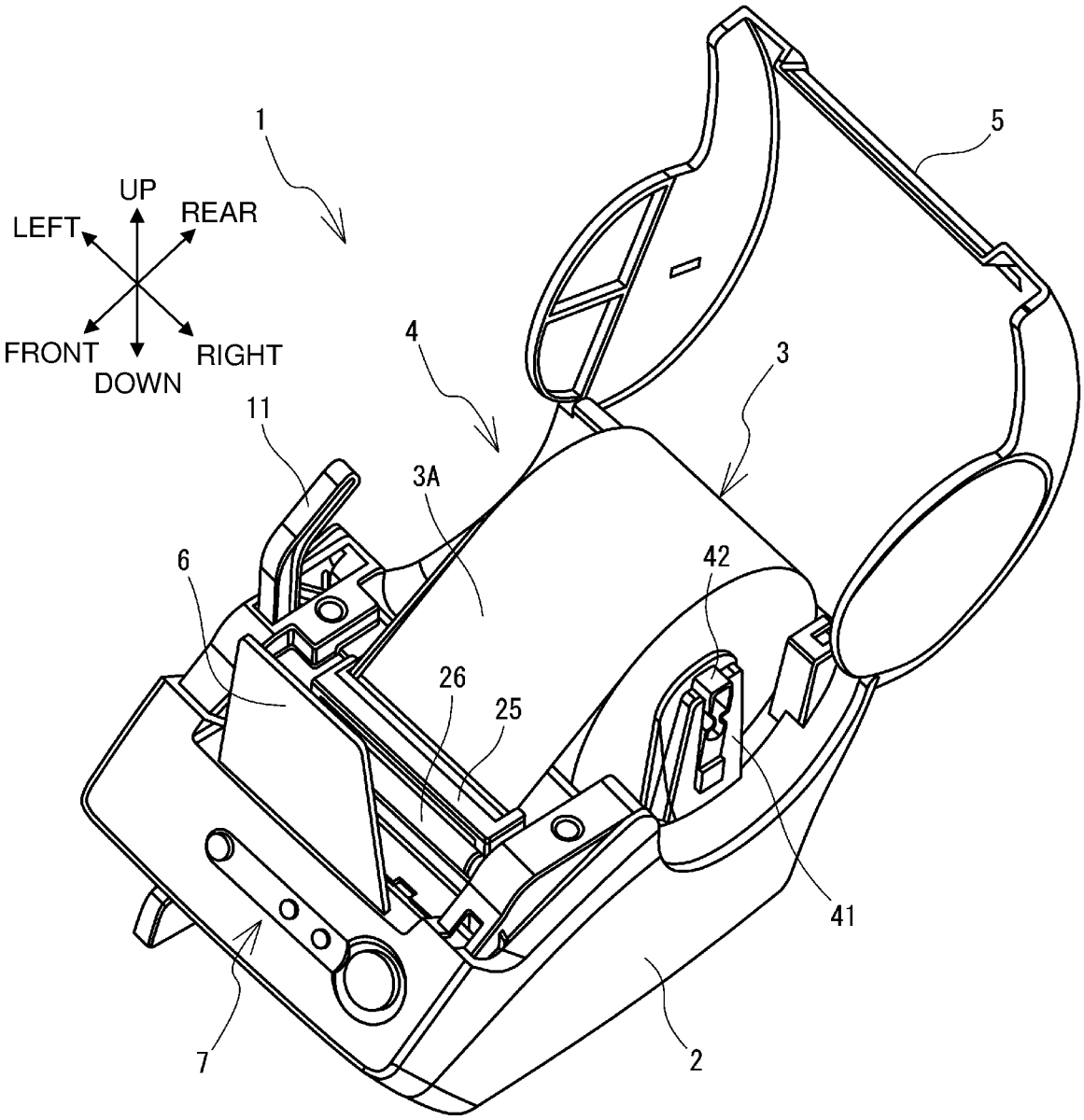
FIG. 1 is a perspective view of a printing apparatus 1.

Referring to the drawings, an embodiment of the present disclosure is explained below. The drawings to be referred to are used for explaining technical features or characteristics that can be adopted by the present disclosure. The configurations of apparatuses or devices depicted in the drawings, the flowchart of the main process, and the like are not intended to be limited only thereto, and they are just examples. In the following, the lower right side, the upper left side, the upper right side, the lower left side, the upper side, and the lower side in FIG. 1 are defined respectively as the right side, the left side, the rear side, the front side, the upper side, and the lower side of a printing apparatus 1.

Outline of Printing Apparatus 1

Figure 2:
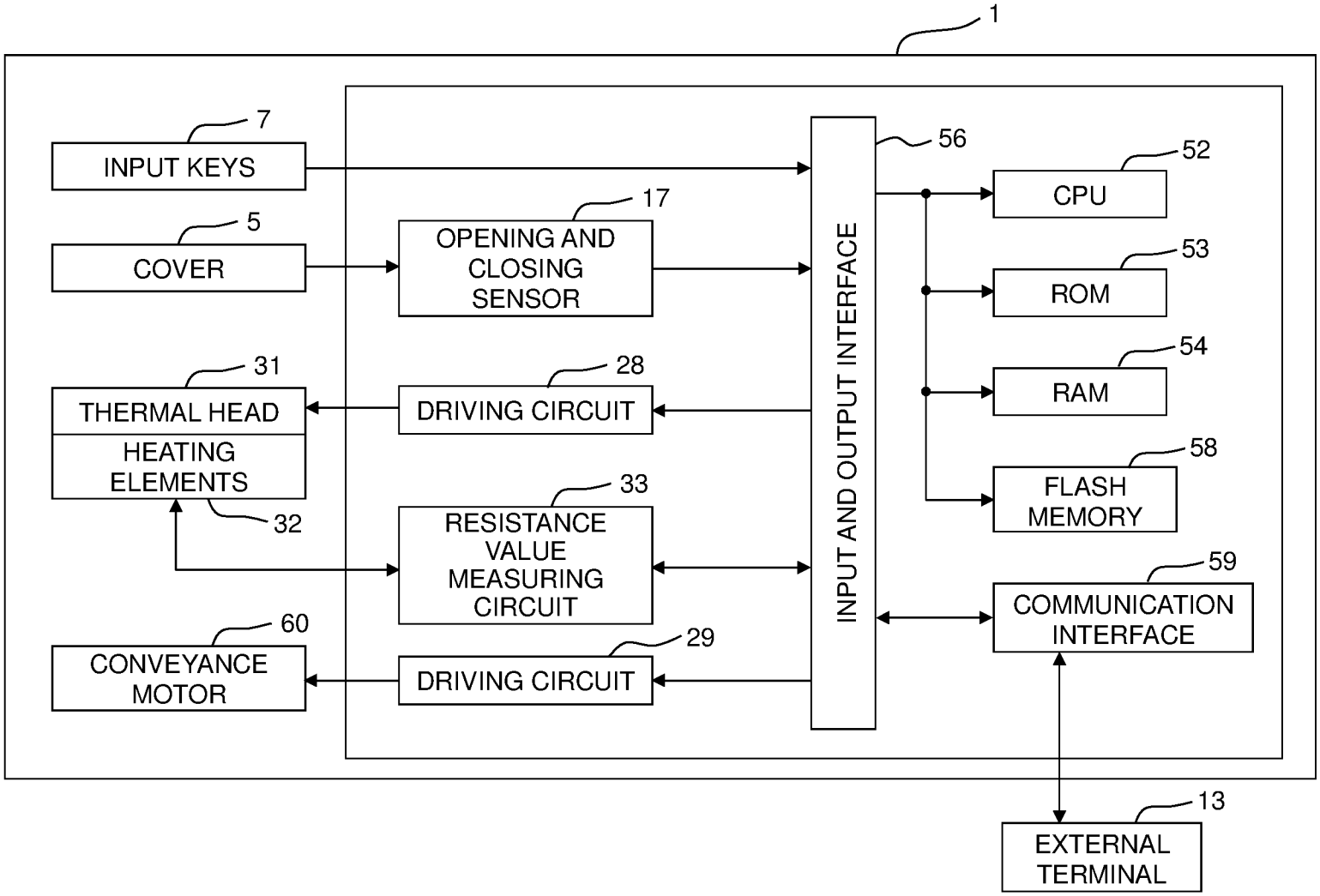
FIG. 2 is a block diagram depicting an electric configuration of the printing apparatus 1.

As depicted in FIGS. 1 and 2, the printing apparatus 1 develops a color of a printing medium 3 in a dot unit by heating the printing medium 3 by use of M of heating elements 32 (see FIG. 2) of a thermal head 31 (see FIG. 2). The printing medium 3 includes a base material and a label attached or stuck on the base material. The printing apparatus 1 includes a casing 2 in which the printing medium 3 wounded into a roll shape is accommodated. The printing apparatus 1 pulls out the printing medium 3 and performs printing thereon. The printing medium 3 is, for example, a die-cut tape.

The printing apparatus 1 includes the box-shaped casing 2 of which upper portion is open. The casing 2 has a substantially rectangular shape as viewed in front view and planar view. The open portion at the upper side of the casing 2 is covered with a cover 5. The cover 5 is rotatable supported by a rear end of the casing 2 by which the casing 2 is opened and closed. Input keys 7 including a power switch are provided on an upper surface of a front end of the casing 2. A plate-like tray 6, which is made from transparent resin, is erected at the rear side of the input keys 7. A discharge opening (not depicted) that is long in the left-right direction is provided at the rear side of the tray 6. The discharge opening is formed by the casing 2 and a front end of the cover 5, The tray 6 receives the printing medium 3 for which printing has been performed and discharged from the discharge opening. A connector (not depicted), to which a Universal Serial Bus cable (USB cable; not depicted) is connected, is provided at a lower portion of a back surface of the casing 2. The USB cable is connected to an external apparatus 13 (see FIG. 2) or the like.

A sheet accommodating portion 4 is provided at a lower portion of the casing 2. The sheet accommodating portion 4 accommodates the printing medium 3. The printing medium 3 is rolled or wounded so that a surface for which printing is to be performed is positioned inside. The printing medium 3 is held by a tape spool 42. The tape spool 42 engages with support portions 41 (see FIG. 1) that are erected at the left and right sides of the sheet accommodating portion 4. The tape spool 42 rotatably supports the printing medium 3 in the sheet accommodating portion 4. A control board 12 (see FIG. 2) is placed below the sheet accommodating portion 4. A CPU 52 and the like controlling the entirety of the printing apparatus 1 are mounted on the control board 12 (see FIG. 2). The CPU 52 is an exemplary controller of this embodiment.

A lever 11 (see FIG. 1) is provided at a left front portion of the sheet accommodating portion 4. A roller holder 25 extending in the left-right direction is provided at the right side of the lever 11. The roller holder 25 rotatably holds a platen roller 26. Closing the cover 5 presses the lever 11 downward. The lever 11 is connected to the roller holder 25. The roller holder 25 moves in the up-down direction along with the movement in the up-down direction of the lever 11 as the fulcrum of a rear end of the lever 11 as the center. Moving the lever 11 downward moves the roller holder 25 downward. The platen roller 26 presses the printing medium 3 against the thermal head 31. This makes the printing apparatus 1 ready for printing. Opening the cover 5 moves the lever 11 upward, which moves the roller holder 25 upward. The platen roller 26 held by the roller holder 25 is separated from the thermal head 31 and the printing medium 3. In that situation, the printing apparatus 1 is in a state in which the replacement of the thermal head 31 can be performed.

The thermal head 31 develops a color by heating the printing medium 3 to form a dot. The thermal head 31, which has a plate shape, includes the M of heating elements 32 (see FIG. 2) arranged on an upper surface thereof. The M of heating elements 32 are arranged in a row in a main scanning direction (left-right direction) orthogonal to a conveyance direction of the printing medium 3. In a position where the thermal head 31 is provided, a direction orthogonal to the main scanning direction is referred to as a sub-scanning direction. The sub-scanning direction coincides with the conveyance direction in the vicinity of the M of heating elements 32. The thermal head 31 is replaceable with respect to a head installation portion (not depicted) of the printing apparatus 1. The main scanning direction corresponds to a first direction of the present disclosure.

The platen roller 26 is pivotally supported by the roller holder 25. The platen roller 26 is disposed above the thermal head 31. The axis direction of the platen roller 26 is parallel to the main scanning direction that is the arrangement direction of the M of heating elements 32. The platen roller 26 faces the M of heating elements 32. The platen roller 26 is urged against the thermal head 31 by use of the roller holder 25. The platen roller 26 is connected to a conveyance motor 60 (see FIG. 2) via a gear (not depicted). The conveyance motor 60 rotates the platen roller 26. The platen roller 26 is driven to rotate with the printing medium 3 interposed between itself and the thermal head 31. This conveys the printing medium 3 in the conveyance direction.

The printing apparatus 1 can be connected to the external terminal 13 via the USB cable. The external terminal 13 is exemplified, for example, by a generic-purpose personal computer (PC), a mobile terminal, and a tablet terminal. A CPU (not depicted) of the external terminal 13 executes a driver soft (not depicted) installed therein to generate printing data from image data.

Electric Configuration of Printing Apparatus 1

Referring to FIG. 2, an electric configuration of the printing apparatus 1 is explained. The printing apparatus 1 includes the CPU 52 that controls the printing apparatus 1. The CPU 52 is connected to a ROM 53, a RAM 54, and a flash memory 58. Programs executed by the CPU 52 are stored in the ROM 53. A variety of temporary data are saved in the RAM 54. Printing data transmitted from the external terminal 13 is saved in the flash memory 58. A first resistance value and a second resistance value described below are saved in the flash memory 58.

The CPU 52 is connected to the input keys 7, an opening and closing sensor 17, driving circuits 28 and 29, a communication interface 59, a resistance value measuring circuit 33, and the like via an input and output interface 56. The input keys 7 provided on the upper surface of the printing apparatus 1 receive the input of operation performed by a user. The opening and closing sensor 17 detects an opened state and a closed state of the cover 5. The driving circuit 28 energizes the M of heating elements 32 provided in the thermal head 31 to heat the M of heating elements 32. The CPU 52 controls the energization for heating the M of heating elements 32 via the driving circuit 28. The driving circuit 29 drives the conveyance motor 60. The conveyance motor 60 is a pulse motor. The CPU 52 outputs a pulse signal to the conveyance motor 60 via the driving circuit 29 to rotate the platen roller 26 (see FIG. 1), This causes the platen roller 26 to convey the printing medium 3 in the sub-scanning scanning direction by one line at a predefined speed. The CPU 52 controls the driving circuits 28 and 29 to form a printing image on the printing medium 3.

The communication interface 59 is an interface that communicates with the external terminal 13 via the USB cable (not depicted). The printing apparatus 1 receives printing data from the external terminal 13 or the like via the USB cable. The communication interface 59 may be an interface that communicates with the external terminal 13 by wireless connection, such as Bluetooth (tradename) and Wi-Fi (tradename). The resistance value measuring circuit 33 can selectively measure resistance values of the M of heating elements 32 of the thermal head 31. Since the detection of the resistance values is performed using a publicly known method, detailed explanation thereof is omitted.

Outline of Measurement of First Resistance Value and Second Resistance Value

The measurement of the first resistance value and the second resistance value for detecting the head replacement is explained. The printing apparatus 1 first measures first resistance values of N of heating elements 32 to detect the replacement of the thermal head 31. Here. N is a natural number smaller than M.

The positions of the N of heating elements 32, of which first resistance values are to be measured, are determined in advance. For example, when the total number of the heating elements 32 is 800 (M=800), the resistance value measuring circuit 33 detects the resistance values of the heating elements 32 arranged in the main scanning direction at every 47 heating elements. In this case, the total number of the heating elements 32 of which first resistance values are to be measured is 17 (N=17).

The resistance value measuring circuit 33 measures the resistance values (first resistance values) of the N of heating elements 32 of the thermal head 31. In this case, the resistance value measuring circuit 33 measures the resistance values of the N of heating elements 32 subjected to the measurement one by one. N of resistance value measured are sequentially saved as the first resistance values in the flash memory 58.

The timing at which the N of first resistance value are measured may be, for example, a timing at which the state of the cover 5 is changed from the opened state to the closed state. This is because the state of the cover 5 changes from the opened state to the closed state when the replacement of the thermal head 31 is performed. Thus, the printing apparatus 1 measures the first resistance values when the opening and closing sensor 17 detects the change from the opened state to the closed state of the cover 5.

Subsequently, the resistance value measuring circuit 33 measures N of second. resistance value. The resistance value measuring circuit 33 measures resistance values of the N of heating elements 32 subjected to the measurement. The positions of the heating elements 32 of which second resistance values are to be measured are the same as those of the heating elements 32 of which first resistance values are measured. N of resistance value are measured one by one in the same order as the order in which the first resistance values are measured. The N of resistance value measured are sequentially saved as the second resistance values in the flash memory 58.

The timing at which the second resistance values are measured may be, for example, a timing at which the state of the cover 5 is changed from the opened state to the closed state. This is because the state of the cover 5 is changed from the opened state to the closed state when the replacement of the thermal head 31 is performed. Thus, the printing apparatus 1 measures the second resistance values when the opening and closing sensor 17 detects the change from the opened state to the closed state of the cover 5.

Outline of Calculation (Operation) of Standard Deviation

The ROM 53 includes an area for storing an operational expression or arithmetic expression (not depicted). The operational expression(s) or arithmetic expression(s) used for detecting the head replacement is/are stored in this area. The operational expressions described below are publicly known expressions used to calculate or operate a standard deviation a. An outline of the operational expressions is described below. Detailed explanation of a case, in which the publicly known operational expression(s) and the like are used, is omitted.

The calculation (operation) of the standard deviation a uses the N of first resistance value and the N of second resistance value measured by the resistance value measuring circuit 33. The N of first resistance value saved in the flash memory 58 are indicated by $R_{old}$ [i]. The N of second resistance value saved in the flash memory 58 are indicated by $R_{new}$ [i]. "i" means a natural number of 1 to N. In this example, N=17 is satisfied. A group of $R_{old}$ [i] and $R_{new}$[i] having "i" in common is indicated by GROUP [i].

The sorting of the first resistance value and the second resistance value subjected to the calculation is explained. Each of the first resistance value and the second resistance value may be a resistance value that can not be subjected to the calculation due to, for example, the effect of error in measurement. When the heating elements 32 are disconnected, the first resistance value and the second resistance value are infinite. When the heating elements 32 are short-circuited, the resistance values are zero. When those resistance values are substituted into expressions (C) and (D) indicated below, the accuracy of detection of the head replacement may be reduced. The CPU 52 is configured not to calculate or operate $R_{old}$ [i] and $R_{new}$ [i] that do not satisfy the following inequalities (A) and (B). Values of $R_{min}$ to $R_{max}$ meaning a predefined range may be set appropriately.

$$R_{min} \leq R_{old}[i] \leq R_{max} \tag{A}$$

$$R_{min} \leq R_{new}[i] \leq R_{max} \tag{B}$$

For example, when any of the first resistance values ($R_{old}$ [3]) and the second resistance values ($R_{new}$ [3]) of the third group (i=3, GROUP [3]) are not included in the range of $R_{min}$ to $R_{max}$, the resistance values of the GROUP [3] are excluded from the calculation subject of the standard deviation σ. The CPU 52 performs the sorting of each of the GROUP [1] to the GROUP [N].

Subsequently, the GROUP [i] of $R_{old}$ [i] and $R_{new}$ [i] subjected to the calculation, namely, the GROUP of the first resistance values and the second resistance values satisfying the inequalities (A) and (B), is substituted into the following expression (C). Namely, difference values between the resistance values detected by the resistance value measuring circuit 33 are calculated for the heating elements 32 having the same position, and a mean value μ of the difference values are further calculated.

$$\mu = \frac{1}{N}\sum_{i=1}^{N}\sqrt{(R_{old}[i] - R_{new}[i])^2} \tag{C}$$

Next, the mean value based on the difference values calculated by the expression (C), the first resistance values ($R_{old}$ [i]) measured, and the second resistance values ($R_{new}$ [i]) measured are substituted into the following expression (D), thus resulting in the standard deviation σ.

$$\sigma = \sqrt{\frac{1}{N-1}\sum_{i=1}^{N}\left(\sqrt{(R_{old}[i] - R_{new}[i])^2} - \mu\right)^2} \tag{D}$$

The standard deviation σ calculated by the formula (D) is compared with a predefined threshold value $\sigma_{th}$. When the expression (E) is satisfied, it is determined that the replacement of the thermal head 31 is performed. For example, the threshold value $\sigma_{th}$ is set as 69.

$$\nu_{th} < \sigma \tag{E}$$

The threshold value $\sigma_{th}$ that is a reference of the detection of the head replacement is set to satisfy the following inequalities (F) to (I). Here, an unbiased variance $\sigma_a^2$ is an unbiased variance of the resistance values of the heating elements 32 of the thermal head 31. More specifically, the unbiased variance $\sigma_a^2$ is an unbiased variance of the difference values between the first resistance values and the second resistance values of the heating elements 32. The unbiased variance $\sigma_b^2$ is an unbiased variance of measurement error when the resistance value measuring circuit 33 measures the first resistance values and the second resistance values of the heating elements 32. In each of the following expressions, "p" is a probability of a confidence interval, $\chi^2$ is a well known chi-square distribution, and [N−1] is the degrees of freedom.

$$\sigma_1^2 = \sigma_b^2 \tag{F}$$

$$\sigma_2^2 = \sigma_a^2 + \sigma_b^2 \tag{G}$$

$$\sigma_1^2 \le \sigma_2^2 \tag{H}$$

$$\frac{(N-1)\sigma_1^2}{\chi^2_{\frac{P}{2}}[N-1]} \le \sigma_{th}^2 < \frac{(N-1)\sigma_2^2}{\chi^2_{1-\frac{P}{2}}[N-1]} \tag{I}$$

In the expression (F), $\sigma_1^2$ indicates the unbiased variance $\sigma_b^2$ of the measurement error when the resistance value measuring circuit 33 measures the resistance values of the heating elements 32. The left side of the expression (I) including a term $\sigma_1^2$ thus indicates a parameter related to the unbiased variance $\sigma_b^2$ of the measurement error of the resistance value measuring circuit 33. Here, a variance $\sigma_{th}^2$ of the threshold value $\sigma_{th}$ is set to be larger than the left side. The reason thereof is as follows. Namely, when the variance $\sigma_{th}^2$ is set to be a value smaller than the left side, the variance $\sigma_{th}^2$ of the threshold value $\sigma_{th}$ is set to be a value smaller than the parameter related to the unbiased variance $\sigma_b^2$ of the measurement error of the resistance value measuring circuit 33. In this case, the printing apparatus 1 is highly likely to erroneously determine that the replacement of the thermal head 31 is performed, even when the replacement of the thermal head 31 is not performed.

In the expression (G), $\sigma_2^2$ indicates the sum of the unbiased variance $\sigma_b^2$ of the measurement error when the resistance value measuring circuit 33 measures the first resistance values and the second resistance values of the heating elements 32 and the unbiased variance $\sigma_a^2$ of the difference values between the first resistance values and the second resistance values of the heating elements 32. Thus, the right side of the expression (I) including a term $\sigma_2^2$ indicates a parameter related to the unbiased variance $\sigma_b^2$ of the measurement error of the resistance value measuring circuit 33 and the unbiased variance $\sigma_2^2$ of the difference values between the first resistance values and the second resistance values of the heating elements 32. Here, the variance $\sigma_{th}^2$ of the threshold value $\sigma_{th}$ is set to be smaller than the right side. The reason thereof is as follows. Namely, when the variance $\sigma_{th}^2$ of the threshold value $\sigma_{th}$ is set to be a value larger than the right side, the threshold value $\sigma_{th}$ is set to be a value larger than the parameter of the sum of the unbiased variance $\sigma_b^2$ of the resistance value measuring circuit 33 and the unbiased variance $\sigma_2^2$ of the heating elements 32. In this case, the printing apparatus 1 is highly likely to erroneously determine that the replacement of the thermal head 31 is not performed, even when the replacement of the thermal head 31 is performed. Therefore, the variance $\sigma_{th}^2$ of the threshold value $\sigma_{th}$ is set based on a value between the left side and the right side of the expression (I).

A value of N is obtained by the following method. For example, when the replacement of the thermal head 31 is not yet performed, the unbiased variance $\sigma_a^2$ operated using the difference values between the first resistance values and the second resistance values is such a small value that can be ignored. Namely, when the replacement of the thermal head 31 is not yet performed, $\sigma_2^2 \approx \sigma_b^2$ is satisfied in the expression (G). In this case, the left side≈the right side≈the threshold value $\sigma_{th}^2$ is satisfied in the expression (I).

For example, it is assumed that the following setting is made based on an actual configuration of the printing apparatus 1: standard deviation $\sigma_1$=30, unbiased variance $\sigma_1^2$=900, standard deviation $\sigma_2$=120, unbiased variance $\sigma_2^2$=14400, and credibility interval P=0.015%. When those values are substituted into the formula (I), and when N=17 is satisfied, the left side≈the right side is satisfied. Namely, when the first resistance value or the second resistance value is measured 17 times, the timing at which the replacement of the thermal head 31 should be performed can be determined accurately while the above reliability is maintained.

The threshold value $\sigma_{th}$ is obtained by the following method. "N" obtained as described above and the above conditions are substituted into the left side and the right side in the expression (I). As a result of the calculation, the variance of the left side is 4749.324, the variance of the right side is 4761.905, the standard deviation σ of the left side is 68.91534, and the standard deviation n of the right side is 69.00656. A mean value of the standard deviation σ of the left side and the standard deviation σ of the right side is thus calculated as approximately 69. In this case, the left side≈the right side≈variance $\sigma_{th}^2$ is satisfied, and thus 69 is obtained as the value of the threshold value $\sigma_{th}$. Accordingly, the printing apparatus 1 can detect the head replacement with a probability of 97%.

Flowchart

Figure 3A:
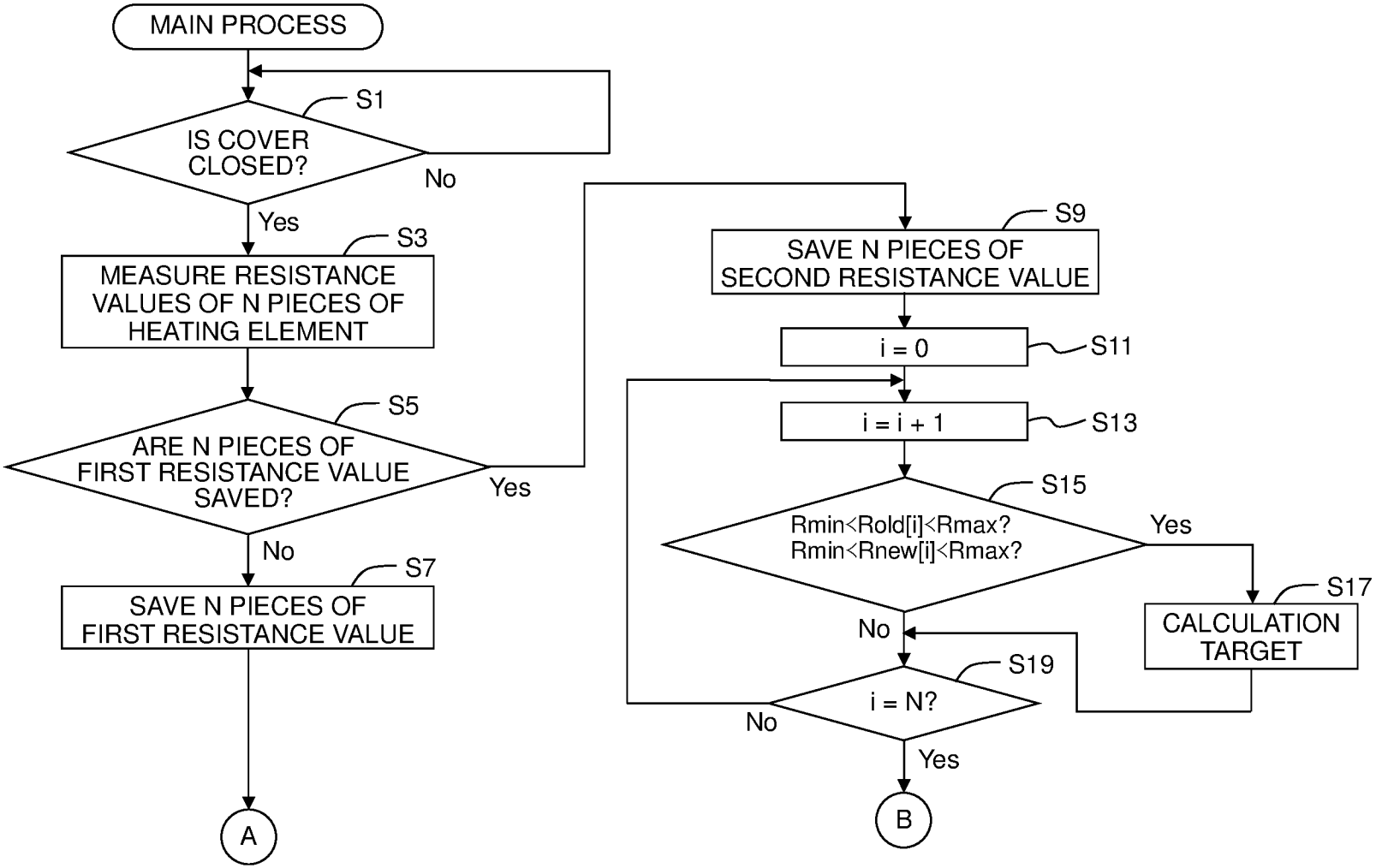
FIGS. 3A and 3B indicate a flowchart of a main process.
Figure 3B:
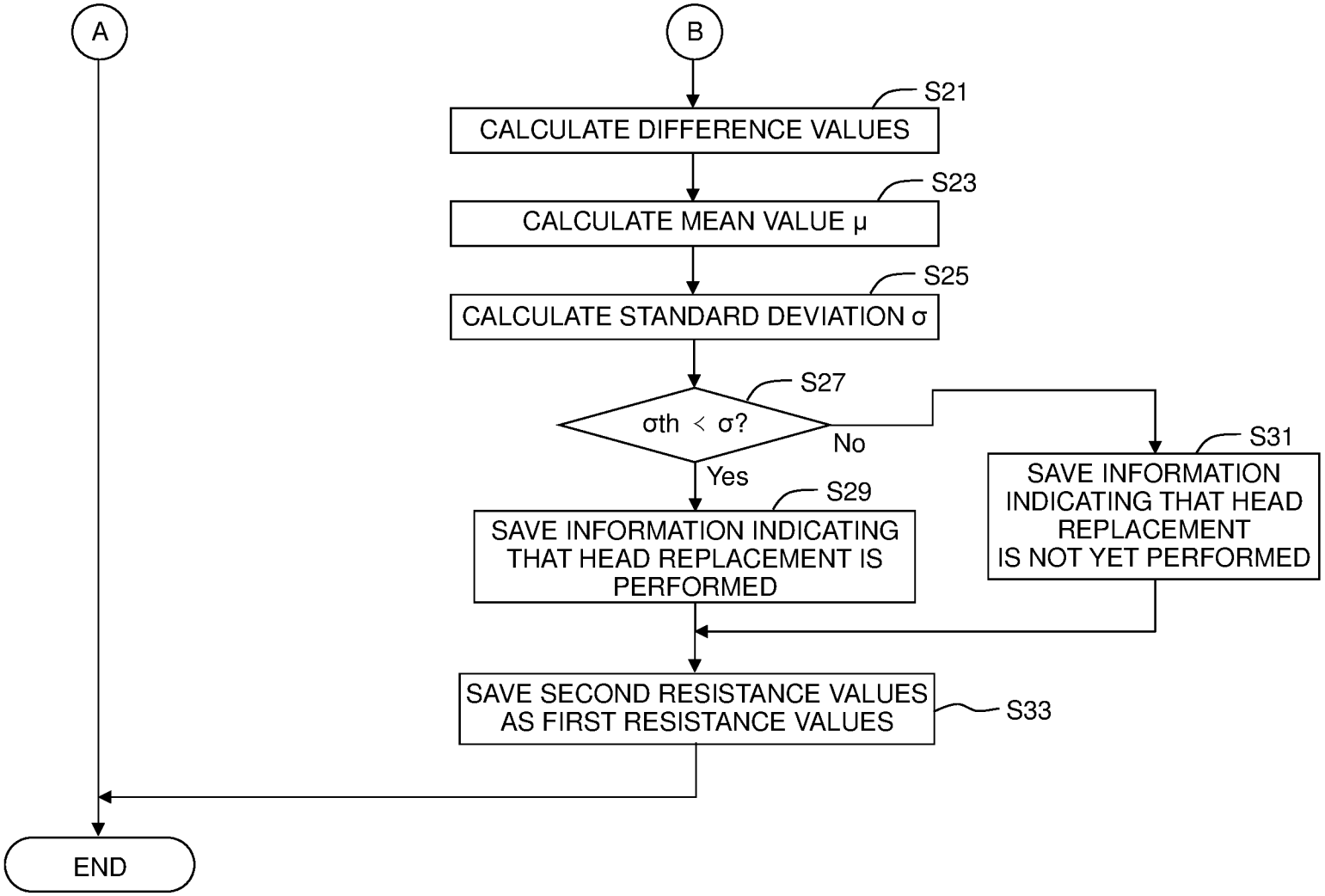

Referring to FIGS. 3A and 39, a main process is explained. When the input key(s) 7 is/are operated to turn on the printing apparatus 1, the CPU 52 reads the program(s) from the ROM 53 and executes it/them. The CPU 52 starts the main process by executing the program(s). When starting the main process, the CPU 52 determines whether the cover 5 is closed (S1). When the CPU 52 has determined that the cover 5 is not closed (S1: NO), the CPU 52 returns to the process S1 and waits until the cover 5 is closed. When the CPU 52 has determined that the cover 5 is closed (S1: YES), the CPU 52 causes the resistance value measuring circuit 33 to measure resistance values of N of heating elements 32 of the thermal head 31 (S3). The CPU 52 determines whether N of first resistance value are saved in the flash memory 58 (S5). When the CPU 52 has determined that the N of first resistance value are not saved in the flash memory 58 (S5: NO), the CPU 52 saves the N of resistance value measured as the first resistance values in the flash memory 58 (S7). Then, the CPU 52 ends the main process. For example, a user turns off the printing apparatus 1 after a predefined print process is executed.

When the input key(s) 7 is/are operated to turn on the printing apparatus 1 again, the CPU 52 reads the program(s) from the ROM 53 and executes it/them. The CPU 52 starts the main process by executing the program(s). When starting the main process, the CPU 52 executes the processes of S1 to S3. The CPU 52 causes the resistance value measuring circuit 33 to measure resistance values of N of heating elements 32 of the thermal head 31 (S3). When the CPU 52 has determined that N of first resistance value are saved in the flash memory 58 (S5: YES), the CPU 52 saves, in the flash memory 58, the N of resistance value measured in the process of S3 as the second resistance values (S9). At this time, the N of first resistance value and the N of second resistance value are saved in the flash memory 58.

The CPU 52 sets "0" to the variable i saved in the RAM 54 (S11). The CPU 52 increments i (S13). The CPU 52 determines (see expressions (A) and (B)) whether the GROUP [i] of the first resistance values ($R_{old}$ [i]) and the second resistance values ($R_{new}$ [i]) saved in the flash memory 58 is within the range of $R_{min}$ to $R_{max}$ (S15). When the CPU 52 has determined that the GROUP [i] of the first resistance value and the second resistance value is within the range of $R_{min}$ to $R_{max}$ (S15: YES), the CPU 52 sets the GROUP [i] as a calculation target of the standard deviation a (S17). Then, the CPU 52 proceeds to a process S19. When the CPU 52 has determined that the GROUP [i] of the first resistance values and the second resistance values is not within the range of $R_{min}$ to $R_{max}$ (S15: NO), the CPU 52 excludes the GROUP from the calculation target of the standard deviation n. Then, the CPU 52 proceeds to the process S19.

The CPU 52 determines whether i=N is satisfied (S19). When the CPU 52 has determined that i=N is not satisfied, namely, when all the N groups of GROUP [i] are not yet compared with the predefined range (S19: NO), the CPU 52 returns to the process S13. The CPU 52 increments i (S13), and repeats the processes of S15, S17, and S19.

When the CPU 52 has determined that i=N is satisfied, namely, when all the N groups of GROUP [i] are compared with the predefined range (S19: YES), the CPU 52 proceeds to a process S21. The CPU 52 calculates difference values ($R_{old}$ [i]−$R_{new}$ [i]) between the first resistance values ($R_{old}$ [i]) and the second resistance values ($R_{new}$ [i]) measured (S21). The CPU 52 calculates the mean value μ using the expression (C) based on the calculated difference values (S23). The CPU 52 calculates the standard deviation n using the formula (D) based on the mean value μ calculated in the process of S17 (S25). The CPU 52 can determine the difference values, the mean value and a characteristic value such as the standard deviation using a predetermined table stored in the flash memory 58, for example.

The CPU 52 determines whether the calculated standard deviation σ exceeds the threshold value of (S27). When the CPU 52 has determined that the calculated standard deviation a exceeds the threshold $\sigma_{th}$ (S27: YES), the CPU 52 determines that the replacement of the thermal head 31 is perform& In this case, the CPU 52 saves, in the flash memory 58, flag information indicating that the replacement of the thermal head 31 is performed (S29). Then, the CPU 52 proceeds to a process S33. When the CPU 52 has determined that the calculated standard deviation a does not exceed the threshold $\sigma_{th}$ (S27: NO), the CPU 52 determines that the replacement of the thermal head 31 is not yet performed. In this case, the CPU 52 saves, in the flash memory 58, flag information indicating that the replacement of the thermal head 31 is not yet performed (S31). The CPU 52 saves, in the flash memory 58, the N of second resistance value saved in the process of S9 as the N of first resistance value (S33). Then, the CPU 52 ends the main process.

When the main process is executed next time, the CPU 52 determines, in the first S5 process, that the N of resistance value are saved in the flash memory 58 (S5). In this case, the CPU 52 saves, in the flash memory 58, the N of resistance value measured by the process of S3 as the second resistance values (S9). Namely, the N of resistance value that are saved in the flash memory 58 at the end of the last main process are used as the first resistance values.

Technical Effects of This Embodiment

As described above, the CPU 52 saves, in the flash memory 58, the first resistance values and the second resistance values of the N of heating elements 32 (S7, S9), and calculates the difference values between the first resistance values and the second resistance values for the respective heating elements 32 (S21). The CPU 52 calculates the standard deviation n based on the calculated difference values (S25). When the CPU 52 has determined that the standard deviation n exceeds the predetermined threshold $\sigma_{th}$ (S27: YES), the CPU 52 determines that the replacement of the thermal head 31 is performed. In this case, the printing apparatus 1 detects the head replacement without using a dedicated sensor. Further, since the printing apparatus 1 only has to measure the first resistance values and the second resistance values of the N of heating elements 32 necessary for the calculation of the standard deviation σ, it is not necessary to calculate the resistance values of all the heating elements 32 (i.e., the M of heating elements 32). The printing apparatus 1 thus shortens a time required for detecting the replacement of the thermal head 31.

It is assumed a case in which the printing apparatus 1 detects the head replacement, for example, when the printing apparatus 1 has determined that the state of the heating elements 32 is changed from a state in which the disconnection of the heating elements 32 is detected to a state in which the disconnection of the heating elements 32 is not detected. In this configuration, the printing apparatus 1 can not detect the head replacement when the heating elements 32 are not disconnected. The printing apparatus 1 of the present disclosure, however, detects the head replacement based on the standard deviation σ, and thus the printing apparatus 1 can detect the head replacement also when the thermal head 31 before replacement is not disconnected. Thus, the printing apparatus 1 can detect the head replacement also when the heating elements 32 are not disconnected.

The printing apparatus 1 calculates the standard deviation σ based on the integrated value of the calculated difference values. This allows the printing apparatus 1 to accurately detect the replacement of the thermal head 31 by use of a statistical technique.

The printing apparatus 1 measures variation in the first resistance values and the second resistance values based on the standard deviation a, and detects whether the replacement of the thermal head 31 is performed. When an error is caused in power supply voltage, the printing apparatus 1 can remove the effect of the error through the calculation of the standard deviation σ. Further, since the printing apparatus 1 only has to obtain the first resistance values and the second resistance values of the N of heating elements 32 required for the calculation of the standard deviation σ, the time required for detecting the replacement of the thermal head 31 can be shortened.

The printing apparatus 1 includes the opening and closing sensor 17 that detects that the cover 5 is closed. When the opening and closing sensor 17 has detected that the cover 5 of the printing apparatus 1 is closed (S1: YES) with the first resistance values being saved in the flash memory 58 (S5: YES), the CPU 52 measures the second resistance values (S5: YES→S9). A user opens the cover 5 to perform the replacement of the thermal head 31, and closes the cover 5 after performing the replacement of the thermal heat 31.

Thus, the printing apparatus 1 reliably can detect whether the replacement of the thermal head 31 is performed by measuring the second resistance values of the N of heating elements 32 after the cover 5 is closed.

Modified Embodiments

A variety of changes can be added to the above embodiment. The printing apparatus 1 detects the replacement of the thermal head 31 by comparing the standard deviation $\sigma$ to the threshold value $\sigma_{th}$. The present disclosure, however, is not limited thereto. For example, the printing apparatus 1 may use, as a target for comparison, a variance $\sigma^2$ calculated based on difference values. In this case, the CPU 52 may compare the variance $\sigma^2$ and the threshold value $\sigma_{th}^2$. This allows the printing apparatus 1 to detect the replacement of the thermal head 31 based on the variance $\sigma^2$. Further, since the printing apparatus 1 only has to obtain the first resistance values and the second resistance values of the N of heating elements 32 required for the calculation of the variance $\sigma^2$, the time required for detecting the replacement of the thermal head 31 can be shortened.

The printing apparatus 1 uses the N of first resistance value and the N of second resistance value measured by the resistance value measuring circuit 33 for the calculation of the standard deviation a. The present disclosure, however, is not limited thereto. The printing apparatus 1 may use particular values (proper values) other than the resistance values related to the thermal head 31. For example, current values or voltage values of the heating elements 32 may be measured as the particular values. In that configuration, the CPU 52 may detect the replacement of the thermal head 31 based on the standard deviation obtained from the current values or the voltage values. Although the resistance value measuring circuit 33 measures the resistance values of the N of heating elements 32 one by one, the resistance value measuring circuit 33 may measure the respective resistance values simultaneously. Instead of measuring the N of first resistance value and the N of second resistance value, the resistance value measuring circuit 33 may measure the M of first resistance value and the M of second resistance value. This enhances the reliability of detection of the head replacement. The printing apparatus 1 may determine that the replacement of the thermal head 31 is performed when threshold value $\sigma_{th} \leq$ standard deviation a is satisfied.

The printing apparatus 1 causes the opening and closing sensor 17 to detect the opened state and the closed state of the cover 5, and the printing apparatus 1 measures the first resistance values and the second resistance values. The measurement timing, however, is not limited thereto. The measurement of the first resistance values and the second resistance values may be performed at a predefined cycle. Further, the CPU 52 of the printing apparatus 1 may measure the second resistance values when the CPU 52 has detected that the power of the printing apparatus 1 is turned on through the operation of the input key(s) 7 with the first resistance values being saved in the flash memory 58. In that configuration, the printing apparatus 1 can reliably detect whether the replacement of the thermal head 31 is performed, for example, when a user turns off the printing apparatus 1 to perform the replacement of the thermal head 31 and turns on the printing apparatus 1 after performing the replacement of the thermal head 31.

The thermal head 31 is an exemplary head of the present disclosure. The flash memory 58 is an exemplary memory of the present disclosure. The first resistance value is an exemplary first eigenvalue of the present disclosure. The second resistance value is an exemplary second eigenvalue of the present disclosure. The opening and closing sensor 17 is an exemplary first sensor of the present disclosure. The input keys 7 are an exemplary second sensor of the present disclosure.

What is claimed is:

1. A printing apparatus comprising:

a head including M of heating elements arranged in a first direction and configured to perform printing of a printing image by heating the M of heating elements while moving relative to a printing medium;

a memory; and a controller configured to:

measure a plurality of first particular values indicating characteristics of N of heating elements included in the M of heating elements at a first timing;

save, in the memory, the plurality of first particular values of the N of heating elements measured;

measure a plurality of second particular values indicating characteristics of the N of heating elements of which first particular values are measured at a second timing, the second timing being different from the first timing;

save, in the memory, the plurality of second particular values of the N of heating elements;

determine a plurality of difference values between the plurality of first particular values and the plurality of second particular values for the respective N of heating elements based on the plurality of first particular values and the plurality of second particular values of the N of heating elements saved in the memory;

determine a characteristic value based on the plurality of difference values; and detect that the head has been replaced to another head, in a case that the controller has determined that the characteristic value exceeds a predefined threshold value.

2. The printing apparatus according to claim 1, wherein the controller is configured to determine the characteristic value based on an integrated value of the plurality of difference values.

3. The printing apparatus according to claim 1, wherein the characteristic value is a standard deviation determined based on the plurality of difference values.

4. The printing apparatus according to claim 1, wherein the characteristic value is a variance determined based on the plurality of difference values.

5. The printing apparatus according to claim 1, further comprising:

a cover; and a first sensor configured to detect that the cover is closed, wherein the controller is configured to measure the plurality of second particular values with the plurality of first particular values being saved in the memory, in a case that the first sensor has detected that the cover of the printing apparatus is closed.

6. The printing apparatus according to claim 1, further comprising a second sensor configured to detect that a power of the printing apparatus is turned on, wherein the controller is configured to measure the plurality of second particular values with the plurality of first particular values being saved in the memory, in a case that the second sensor has detected that the power of the printing apparatus is turned on.

* * * * *